US005253519A

United States Patent [19]

Muschotti et al.

[11] Patent Number: 5,253,519

[45] Date of Patent: Oct. 19, 1993

[54] METHOD AND DEVICE FOR IN-SITU MEASUREMENT OF GROUND HEAVE CHARACTERISTICS

[75] Inventors: Ernest Muschotti, La Seyene Sur Mer; Etienne Flavigny, Grenoble, both of France

[73] Assignee: Societe Anonyme Stiled E.R.G., La Seyne Sur Mer, France

[21] Appl. No.: 778,129

[22] PCT Filed: May 25, 1990

[86] PCT No.: PCT/FR90/00368

§ 371 Date: Nov. 27, 1991

§ 102(e) Date: Nov. 27, 1991

[87] PCT Pub. No.: WO90/15324

PCT Pub. Date: Dec. 13, 1990

[30] Foreign Application Priority Data

Jun. 9, 1989 [FR] France ..... 89 07294

[51] Int. Cl.[5] ..... E21B 47/00

[52] U.S. Cl. ..... 73/155; 73/151

[58] Field of Search ..... 73/151, 155, 38

[56] References Cited

U.S. PATENT DOCUMENTS

| | | | |
|---|---|---|---|
| 2,688,872 | 9/1954 | Hartline et al. | 73/155 |
| 3,858,441 | 1/1975 | Comeau | 73/151 |
| 3,861,196 | 1/1975 | Domenighetti | 73/38 |
| 4,353,249 | 10/1982 | Lagus et al. | 73/155 |
| 4,420,975 | 12/1983 | Nagel et al. . | |
| 4,484,626 | 11/1984 | Kerfoot et al. | 73/155 |
| 4,495,805 | 1/1985 | Dowling et al. | 73/155 |
| 4,899,320 | 2/1990 | Hearn et al. | 73/155 |
| 4,922,758 | 5/1990 | Penny | 73/38 |

FOREIGN PATENT DOCUMENTS

| | | | |
|---|---|---|---|
| 1586243 | 2/1970 | France . | |
| 2512860 | 3/1983 | France . | |
| 0033920 | 2/1987 | Japan | 73/38 |
| 817295 | 7/1959 | United Kingdom . | |

OTHER PUBLICATIONS

LeBlanc et al., "Numerical Surface Control Device for In-Situ Ground and Rock Tests with a Deep Drill", a translation of French patent application number 2512860.

*Primary Examiner*—Hezron E. Williams
*Assistant Examiner*—George Dombroske
*Attorney, Agent, or Firm*—Ladas & Parry

[57] ABSTRACT

An improved method and apparatus for performing pressiometric tests are disclosed, wherein an expansible or inflatable sensor is introduced into a borehole, liquid is supplied to saturate the surrounding ground, and a ground characteristic is measured by monitoring changes in the pressure and volume of the sensor. Thereby, the tendency of the ground to heave is measured.

16 Claims, 4 Drawing Sheets

METHOD AND DEVICE FOR IN-SITU MEASUREMENT OF GROUND HEAVE CHARACTERISTICS

The present invention has for its object methods and devices for in-situ measurement of ground heave characteristics.

The technical sector of the invention is the manufacture of material and equipment for carrying out mechanical tests and measurements of ground in-situ.

One of the principal applications of the invention is the determination of ground heave prior to construction of a work thereon.

In fact, numerous works, dwelling houses of low height or industrial implantations, have suffered damage due to expansive ground and especially to heaving ground.

In France, several cases of ground-heave disorders have been noted in the Paris region by Mr. PHILIPPONNAT. Other examples are cited in Rumania (Mr. POPESCU), in Senegal (Mr. THUREAU) or in the United States (Mr. CHEN) for example. It may be noted that these disorders are all raised in clayey soils in arid or semi-arid climates, i.e. in a non-saturated environment.

These expansive clayey soils provoke serious problems for constructions, all the more so as the latter are light. Moreover, such disorders are amplified with time, very slowly, as the works progressively lose rigidity. The most current disorders due to heaving soils are differential deformations, as well as cracks which open and close at the rhythm of the seasons and therefore of the retraction-heaving cycle of the clayey soil.

Certain constructions are sometimes ruined by disorders of this type. The parts most exposed to the action of the heaving ground are the foundations and numerous constructional arrangements are recommended with a view to protecting them, but without optimalization due to lack of measurement and knowledge of the value and of the risk run, which is expensive when it is desired to be sure of avoiding any risk.

In particular, the following may be used:

- a preventive treatment of the foundation soil;
- an adaptation of the structures;
- a peripheral drainage with a view to obtaining a hydric balance of the ground.

These preventive arrangements which are expensive due to lack of optimalization are in that case rathermore often ignored.

It therefore appears necessary to prevent heaving of the foundation ground and therefore to be capable of determining, by a test either in-situ or in laboratory, the propensity for future heaving of the clay constituting the ground. The reaction mechanisms of grounds are in fact very complex and are linked with their internal structures, however, which are often very heterogeneous and non-repetitive. The grounds may be classified by internal structures into categories, but the characteristics thereof cannot be quantified without the tests. Therefore, numerous publications, measurements and studies have been made and are being made on each parameter concerned by the problems of heaving with which we are preoccupied, such as, for non-saturated ground, the suction in the soils, the hydrodynamic behaviour and the flow of the water, the effective stress, and the resistance to shear.

Various apparatus have been developed to effect measurements of these parameters, knowing that, for a given parameter, there exists a range of equipment, often a function of the range of value to be measured.

However, it has proved that the principal information concerning the study of non-saturated ground is that of the values of its suction, and there exists a correlation between the drop thereof and the increase in heave, which correlation is one of the keys of the perception of the mechanisms and parameters of the heave.

This aptitude of ground to heaving is at the present time studied only in the laboratory on the basis of so-called "oedometric" tests on samples.

The most conventional method, to within some variants, remains that recommended by PAREZ and BACHELIER which, by a servo-controlled counterweight, prevents the sample from heaving and makes it possible without difficulty to determine the value, after stabilization, of the pressure exerted, which is the heaving pressure.

In fact, the heaving pressure of a ground may be defined either:

- as the pressure which must be applied to ground for no variation in volume to occur therein during saturation thereof;
- as the pressure which must be exerted on ground to return it after saturation to its initial volume before saturation.

The first of these two definitions is the most conventional and remains the one employed by the majority of authors.

However, these methods consider the problem of heave as being a unidirectional phenomenon, whilst the evidencing of the anisotropy of the heave in non-saturated grounds should incite one no longer to be limited to one direction of heave, but to study on apparatus deriving more from one triaxial cell than from an "oedometer".

Moreover, these laboratory tests are long, expensive, do not give a response in real time, therefore delay the information and decision and disturb the organization of a work-site. Furthermore, the sample which is conveyed from the site to the laboratory may change state during transport and in time, and the values measured are no longer representative.

Moreover, this explains that these laboratory tests are effected only rarely for the needs of a work-site, for which either one is at a dead-end or the risks are overprotected; these tests are used especially in research and expert opinions and it is, moreover, unimaginable to carry these tests out in-situ.

However, for several years, the majority of current foundation studies are effected by exclusively employing tests in situ as means for parametering the foundation calculations, from penetrometers for example or equipment marketed under the Trademark "Pressiomètre" in particular. It is therefore useful and interesting also to be able to effect measurements of heave and, if possible, by using the maximum of implementation means which would be common to the other tests and measurements effected.

In fact, various equipment exist for in-situ measuring pressure and shear in ground, and the measurement of the capacity of heave is also based on measurements of pressure, but the process for effecting measurement and analysis is different from the existing known methods and forms the subject matter of the present invention.

In this domain, various Patents may be cited which were filed several years ago, such as in particular those of the firm MENARD, which has been the precursor in this domain for more than 30 years and is holder of the Registered Trademark designating this equipment, the "PRESSIOMETRE". One of its latest Patents, filed on Jun. 13, 1981 and published on Mar. 18, 1983 under No. 2,512,860, entitled "Surface control device of digital type for in-situ ground and rock testing with deep probe", essentially claims means and processes for calculating from the measurements made to obtain results in-situ, despite the operational servitudes. The "PRESSIOMETRE" apparatus used by this firm to obtain these measurements are known, furthermore, and comprise:

- a deep probe comprising a principal expandable cell, inflatable by liquid pressure, and generally framed by two guard cells of the same type which are stressed under gaseous pressure, and
- connected to the deep probe by a mixed liquid/gas pipe, a surface device making it possible to vary the pressure or pressures, at the same time as detecting the variations in volume of the principal cell.

Other details on these apparatus are available in the work "THE PRESSUREMETER AND FOUNDATION ENGINEERING" by F. BAGNELIN, J. F. JEZEQUEL, D. H. SHIELDS, in the series on Rock and Soil Mechanics, Vol. 2 (1974/77) No. 4, Trans. Tech. Publications, Clansthal, Germany 1978.

Furthermore, the Patent filed on Jun. 21, 1985 by the firm SOPENA, published on Dec. 26, 1986 under No. 2,585,876 and entitled "Process and device for measuring the shear characteristics of ground" may also be cited: the invention claimed makes it possible, apart from measuring radial pressure as in the apparatus of the firm MENARD described hereinabove, to measure in-situ the axial traction applicable to the probe and provoking rupture of the ground by shear, and this thanks to an elastic envelope of this probe outside which pressure shells are mounted.

In this way, each of these apparatus furnishes results of measurements each corresponding to a characteristic of the ground and are therefore complementary of one another depending on what is sought.

However, none in their known configuration and process of use, makes it possible to measure and to know the pressure and expansion of heave of ground.

The problem raised is therefore, from existing means employing known equipment available in the public domain for measuring pressure of the ground in-situ, to adapt a probe and a surface apparatus for measuring the characteristics of heave of the ground on the work-site.

One solution to the problem raised is a method for measuring in-situ, employing an expansible sensor, means for introducing this sensor in the ground, means for monitoring the radial pressure exerted on the ground by the sensor and such that:

- said expansible sensor is introduced to the desired depth in a bore-hole made in the ground to be studied, and a known, normal pressiometric test is made, consisting in establishing the curve of variation of the pressure of the sensor and therefore in the ground therearound, as a function of the volume of expansion of this sensor and therefore of the compressed volume of the ground;
- a fluid is supplied in said ground surrounding at least part of the sensor and from the point of return of the ground to its initial state, as if there were no bore-hole, which fluid impregnates the ground, under a low charge corresponding to some meters of column of this fluid;
- the volume of said sensor is simultaneously monitored so that it remains constant, in that case increasing the pressure therein, up to saturation of the ground by the fluid, i.e. up to the point where said volume again varies compulsorily with said pressure;
- the difference in pressure measured between the points, corresponding to the pressure of heave of the ground, is calculated.

From the preceding point of return of the ground to its initial state and the supply of the fluid in this ground around the sensor, it is possible, according to another method of the invention, to monitor the pressure in said sensor so that it remains constant, in that case reducing the volume thereof up to saturation of the ground by the fluid, i.e. up to the point where said pressure again varies compulsorily with said volume, and the difference in volume measured between the points, corresponding to the free expansion due to the heave of the ground, may be calculated.

Finally, the principal object of the invention is attained when said calculations of pressure of ground heave at constant volume and of expansion of the ground at constant pressure are effected successively one after the other, moving along the pressure variation curves as a function of the volume for a fluid-saturated ground, measuring the values of pressure and of volume between the points of these curves corresponding either to the volume, or to the pressure of the point of return of the ground to its initial state, before impregnation.

Another solution to the problem raised is a device for measuring in-situ the ground heave characteristics comprising, in known manner, an expansible sensor, means for introducing and expanding the latter in the ground and means for monitoring the radial pressure exerted on the ground by the sensor; which device comprises injection means for supplying in the ground surrounding at least a part of said sensor, a fluid which impregnates the ground, under a low charge corresponding to some meters of column of this fluid, this device, in a preferred embodiment, comprises at least two parts, inflatable independently of each other, one allowing standard, conventional measurements of ground pressure in its initial state, the other associated with said fluid injection means allowing measurements of ground heave pressure simultaneously to the impregnation of the ground up to saturation, either at constant pressure or at constant volume.

The result is new methods and devices for measuring in-situ the ground heave characteristics. These methods and devices bring numerous advantages with respect to the present techniques, of which, it must be repeated, none makes it possible at the present time to measure in-situ the sought-after heave characteristics, the latter being effected in the laboratory, therefore in deferred time with the drawbacks mentioned hereinabove.

Moreover, the adaptation of the present invention to existing measuring equipment makes it possible, on the one hand, to reduce the cost of implementation and of investment, but, on the other hand, to reset the measurements made with respect to the known calibrations effected precisely with this equipment. In fact, the mechanical characteristics of the ground are often not abolute measurements but especially relative ones, and it is therefore necessary and important to have the same basic measurement references especially as it is from certain of them that standards have been established in building construction.

Moreover, the conventional pressiometric profile may then be continued in the same bore-hole to a greater depth, outside the potential heave zone.

In preferred embodiments, the duration of the so-called "dry" reference test with a sensor in two independent inflatable parts is advantageously employed to effect inflation, as the time of impregnation of the ground corresponds approximately to the duration of the preceding so-called "dry" test, viz. of the order of 15 minutes; this makes it possible to save intervention time.

Finally, improvements and additional probes may be inserted in the sensor to follow, for example, the interstitial pressure.

In the following description, we are essentially describing examples of methods and of devices according to the invention, but other tools and sensors may be envisaged within the framework thereof: the drawings, Figures and description have no limiting character.

Figure 1:
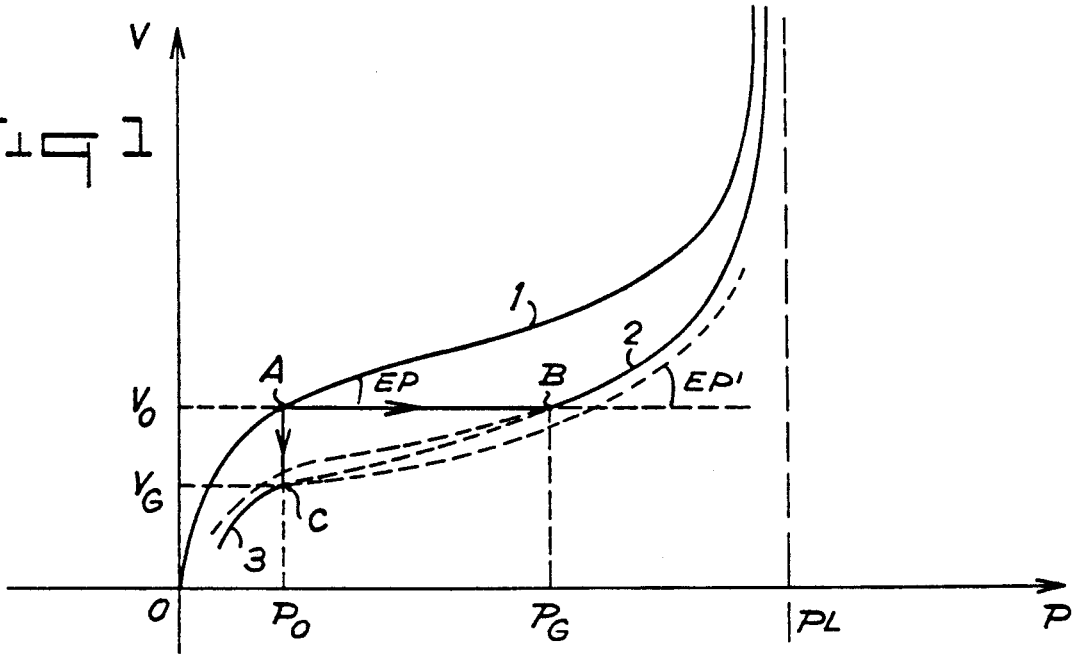
FIG. 1 is a representation of the curve of the values of pressure and of volume.
Figure 2:
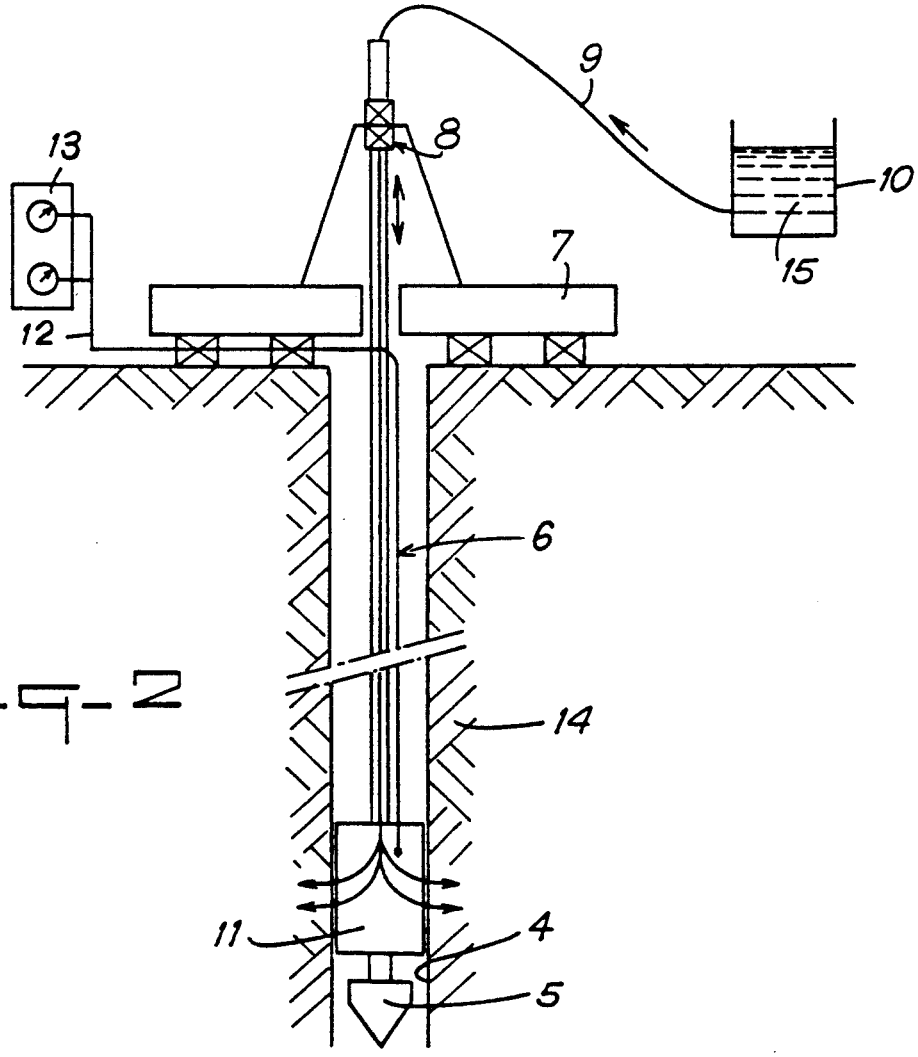
FIG. 2 is a view in section of the whole of the measuring device.

FIG. 1 represents an orthogonal axis reference mark of which the x-axis (P) represents the values of pressure in an inflatable sensor, after a hole has been bored in ground and introduction of this sensor having an outer diameter approximately equal to the hole made, generally for example of the order of 63 mm for the existing apparatus, and the y-axis (V) represents the values of volume of this sensor. These values are measured on the surface as shown in FIG. 2.

In operation, the user measures and plots a natural pressure/volume curve 1 which he then uses to determine, manually, the characteristics of the ground including a normal pressiometric module EP and a conventional limiting pressure PL (values of which the significance is linked with basic data on the "Pressiomètre" apparatus). As a general rule, one firstly proceeds with a calibration, the sensor being in the free air, approximately at the level of the surface device; then, with the sensor buried in a bore-hole, the measurements proper are effected, from which are subtracted the calibration values in order to eliminate the response proper of the sensor.

The "pressiometric" module is the slope of the curve 1 at point A corresponding to the return of the ground to its initial state before drilling.

Point A therefore gives the pressure $P_O$ and the initial volume $V_O$ which characterized that part of the ground of which the sensor took its place.

Once the sensor according to the invention and as described in the following Figure, is placed in the bore-hole at the desired location and positioned in pressure and volume values to correspond to this point A, a fluid is supplied in the ground surrounding at least a part of the sensor, which fluid impregnates the ground under a low charge, corresponding to some meters of columns of this fluid.

Various methods of measurements are then possible:

a) either the volume of the sensor is monitored at the same time as said supply of fluid in the ground, for said volume to remain constant, in that case by increasing the pressure therein up to saturation of the ground by the fluid, i.e. by passing through right-hand segment AB in the Figure up to point B where said volume V can in that case only increase with said pressure P, then making it possible to plot curve 2. This curve then represents the phase of expansion of the sensor after inflation of the ground to saturation: the limiting pressure PL is, a priori, not affected by the impregnation of the ground, whilst the module $E_P$ is affected. The difference in pressure measured between points B and A, or $\delta P = P_G - P_O$, then corresponds to the pressure of heave of the ground.

b) the pressure in the sensor is monitored at the same time as this supply of fluid, for said pressure to remain constant and equal to $P_O$, in that case reducing its volume up to saturation of the ground by the fluid, i.e. passing through segment AC in the Figure up to point C where said pressure can then only decrease with the volume, making it possible to plot curve 3. This latter curve, if it is extended by re-increasing pressure P and therefore volume V, must normally merge with preceding curve C and pass through point B, as it is question of the pressure-volume curve of the saturated ground.

The difference in the volumes measured between points A and C, viz. $\delta V = V_O - V_G$ corresponds to the volume of free expansion due to the heave of the ground.

c) if it is not desired to make two different measurements at two different points, which would risk not being concordant, the heave pressure may be measured by passing through segment AB as indicated hereinabove in a), then, once the fluid has been supplied up to saturation of the ground, the pressure $P_G$ in the sensor is made to drop, then following curve 2 or 3, until the initial pressure $P_O$ is obtained, returning to point C for which the volume $V_G$ of the sensor is measured, making it possible to calibrate the volume of free expansion $\delta V$ as indicated hereinabove in b).

d) or the volume of free expansion $\delta V$ may firstly be measured as hereinabove in b), then, by increasing the pressure in the sensor, rise to point B and measure the heave pressure as in a) hereinabove; methods c) and d) are equivalent as to the definition of this heave pressure.

FIG. 2 is an overall view in section of the measuring device which comprises a known support fixed on ground 14, making it possible, from any type of drilling means 8, to make a bore-hole 4 at the location and at the depth where it is desired to effect the measurement.

In a preferred embodiment, equipment such as for example that of the apparatus designated under the Registered Trademark "Pressiomètre" is used, which further comprises a known equipment 13 for monitoring the pressure and volume of any deformable sensor 11 which is connected thereto by at least one conduit 12.

Figure 3:
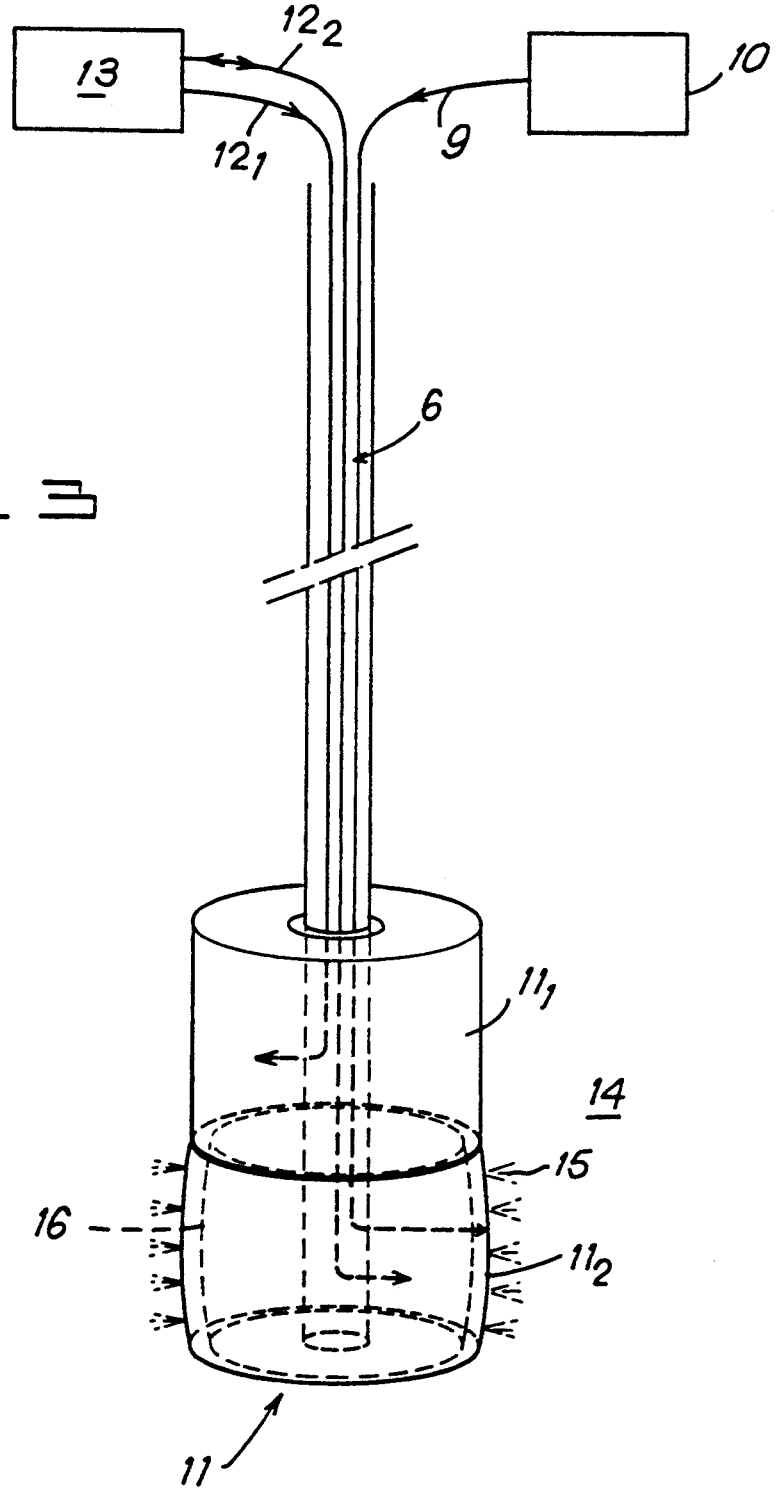
FIG. 3 is a simplified view in perspective of the sensor in two superposed inflatable parts.

The preferred embodiment of the sensor 11 according to the invention is doubled, however, as described with respect the following FIG. 3, and connected in fact by two conduits $\mathbf{12}_1$, $\mathbf{12}_2$ to the equipment 13.

The sensor possibly provided with a beating tip 5 is introduced and descended in the bore-hole by a series of rods 6 down to the depth where it is desired to effect measurement.

Moreover, a tank 10 containing any fluid 15 is also connected to said sensor 11 via a conduit 9 passing, or not, in the series of rods 6, like the conduit 12 connected to the measuring device 13. This fluid 15, contrary to that used for expanding the sensor and which is therefore of a determined and recoverable volume, is lost and used for impregnating at least a part of the ground 14 around the sensor 11, in which it is injected under a low charge corresponding to some meters of column of this fluid. Its injection may thus be effected by simple gravity, and this fluid is preferably water.

FIG. 3 is a simplified view of an example of said sensor 11 constituted, in order to obtain the best result of measurement according to the method, by two parts inflatable independently of each other, making it possible to effect the measurements in accordance with one of the methods of the invention described in FIG. 1, in particular, simultaneous measurements of normal pressure and of heave pressure.

In this Figure, the two parts are in fact two superposed inflatable sensors: the upper part $11_1$, supplied via a conduit $12_1$ from the apparatus 13 through for example the series of rods 6, is of known type and allows standard, conventional measurements of ground pressure in its initial state; the lower part $11_2$ is itself supplied via a conduit $12_2$ from apparatus 13 to allow measurements of ground pressure around it like the preceding one, but, in addition, it is associated with said reservoir 10 of fluid 15 via conduit 9: the fluid may then be injected into the ground 14 through a double wall 16 for example, surrounding all or part of the lower sensor $11_2$ over its periphery: the inner, tight wall thereof then acts as pressure transmitter for the measurement, like the wall of an inflatable sensor, and the porous outer wall comprising orifices induces no parasitic pressure which may influence the measurements when there is balance of impregnation saturation of the ground by the fluid 15 and when the latter can no longer be injected.

Figure 4:
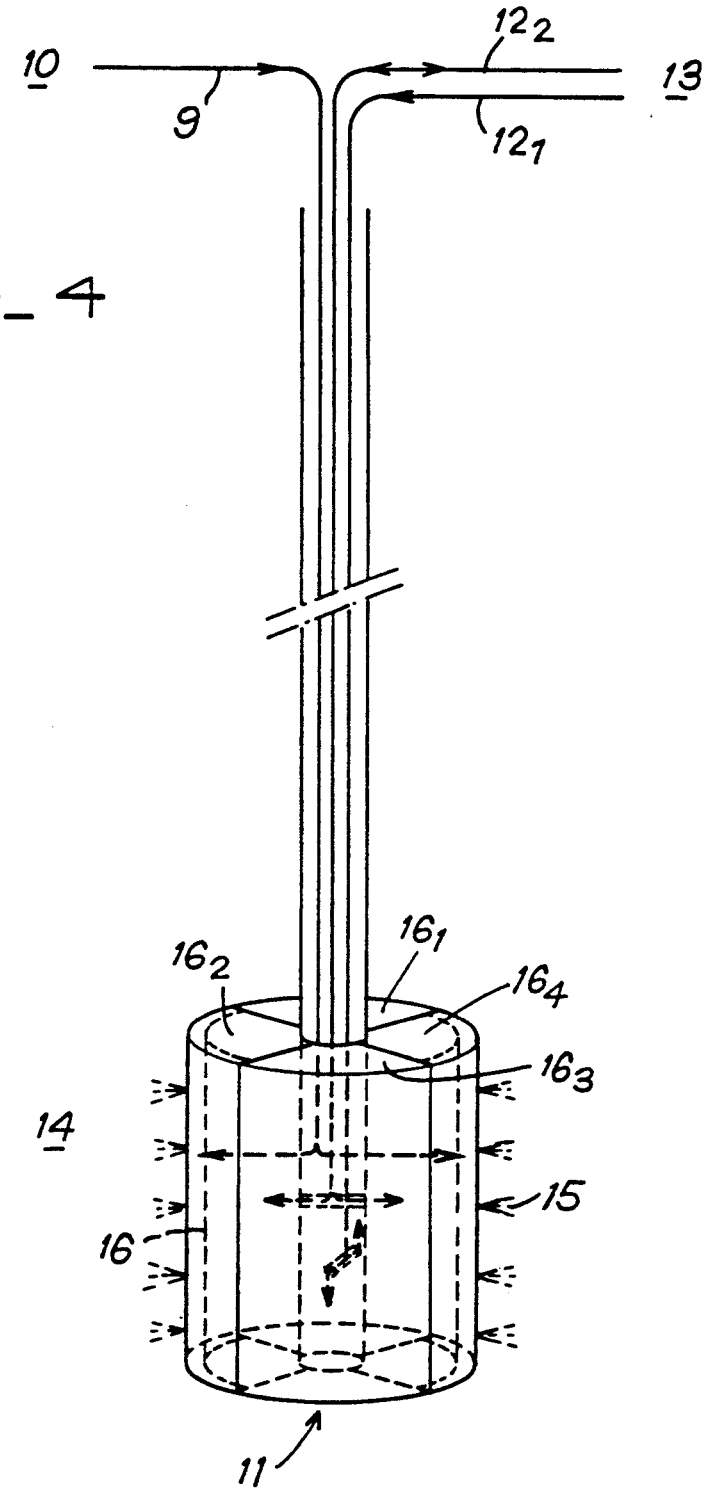
FIG. 4 is a simplified view in perspective of the sensor in four inflatable sectors.

FIG. 4 is a simplified view of another example of said sensor 11, also constituted by two parts inflatable independently of each other, of which each part is itself split, so that the sensor 11 is in fact constituted by at least four inflatable sectors $16_1$, $16_2$, $16_3$ and $16_4$ coupled in two's in opposition and then working in the same strata of the ground 14, which may be preferable.

The part constituted by sectors $16_1$ and $16_3$ is connected via a conduit $12_1$ for the measurements of standard, conventional pressures from apparatus 13. The part constituted by sectors $16_2$ and $16_4$ is connected via a conduit $12_2$ to this apparatus for measurements of heave and, moreover, it is connected to reservoir 10 of fluid via conduit 9 for injection of this fluid 15 in the ground, through for example, as in the preceding Figure, a double wall 16 covering the only outer surface of sectors $16_2$ and $16_4$.

In another variant, the sectors may each be covered with a rigid outer wall of which the two covering sectors $16_2$ and $16_4$ comprise channels and orifices through which passes the fluid brought directly via conduit 9, in plan.

Figure 5A:
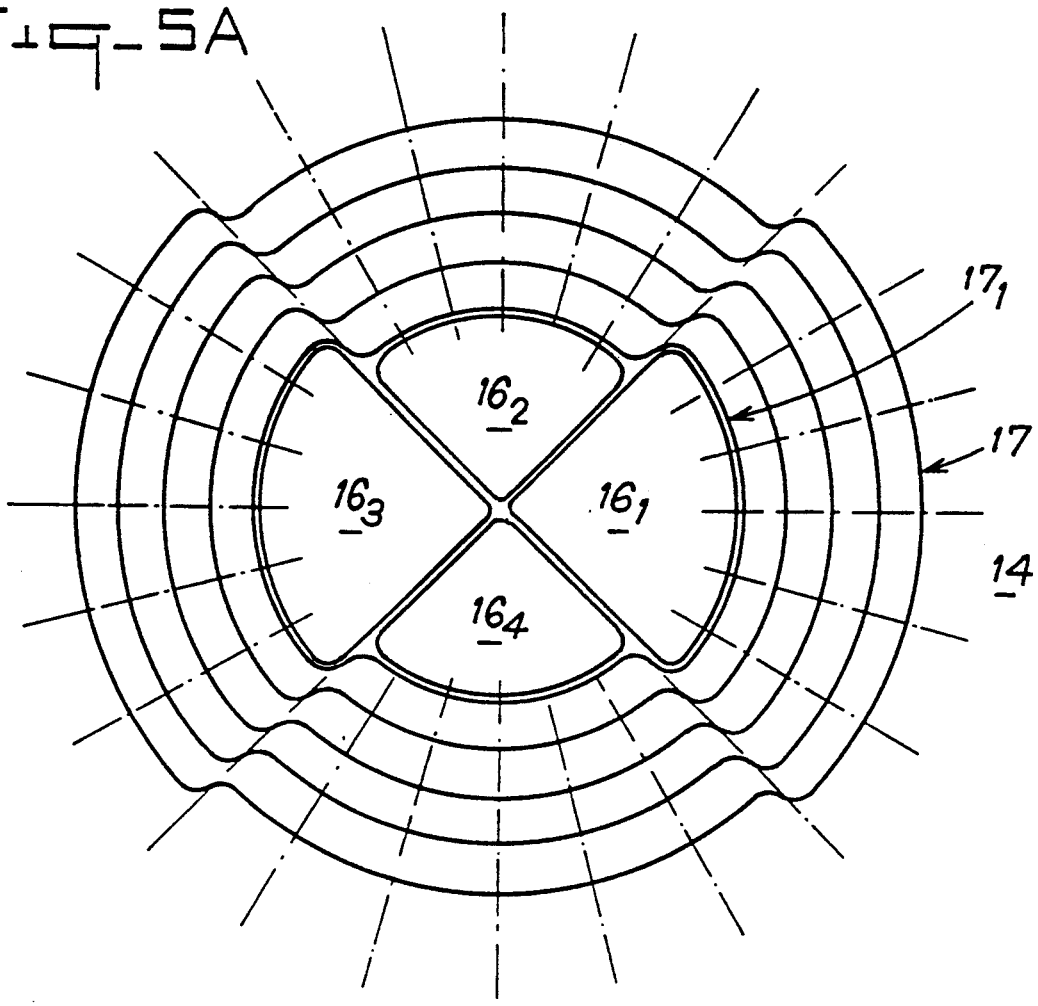
FIGS. 5A and 5B are representations in top plan view of the deformation of ground by the four-sector sensor.
Figure 5B:
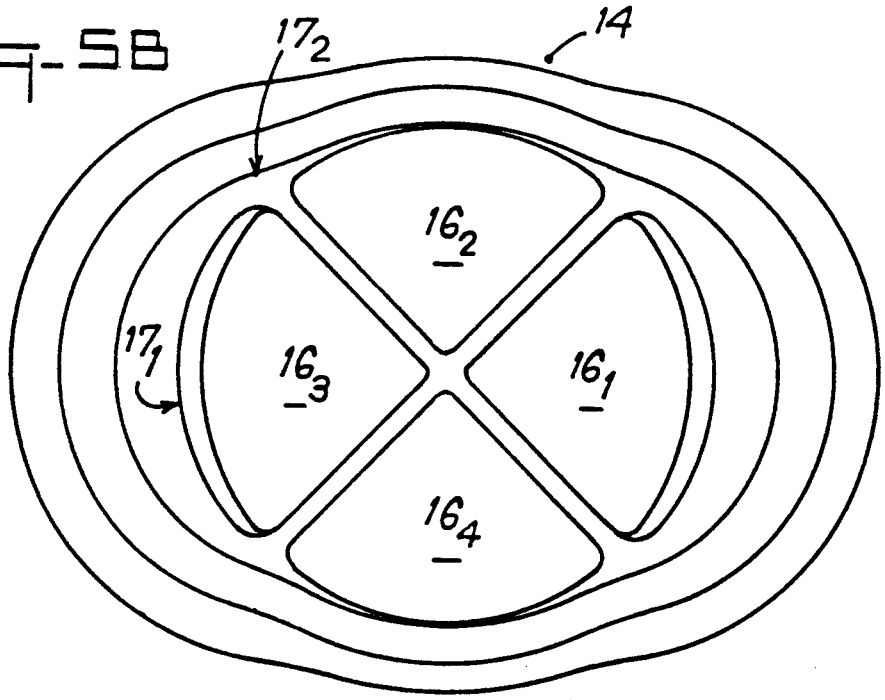

FIGS. 5A and 5B are top or underneath representations of the deformation of ground 14 by the sensor described in preceding FIG. 4. Each line 17 corresponds to one isobar.

In FIG. 5A, the pair of sectors $16_2$ and $16_4$ is shown here after injection of fluid in the ground in the position of point C of FIG. 1, whilst sectors $16_1$ and $13_3$ are in the position of normal pressure of ground 14, viz. at point A of FIG. 1. The first line of pressure $17_1$ therefore corresponds to pressure $P_O$ and the difference in volume measurable between the pair of sectors $(16_1+16_3)$ and $(16_2+16_4)$ represents the variation of expansion of the ground $V_G-V_O$.

In FIG. 5B, the pair of sectors $16_2$ and $16_4$, again represented after injection of fluid in ground 14, is here returned to the same volume as sectors $16_1$ and $16_3$ with, therefore, an overall periphery of the sensor in the form of a circle: in this way, all the sectors correspond to the volume of the ground reconstituted in its initial position before drilling. Sectors $16_1$ and $16_3$ are always in the position of normal pressure on a point A of FIG. 1, and sectors $16_2$ and $16_4$ are at point B of this Figure.

The first line of pressure $17_1$ corresponding to the pressure $P_O$, therefore stops near the ends of sectors $16_1$ and $16_3$, whilst line $17_2$ following the outer wall of sectors $16_2$ and $16_4$ correponds to the heave pressure $P_G$ and then moves away from sectors $16_1$ and $16_3$. The difference in pressure $P_G-P_O$ is the ground heave pressure.

We claim:

1. In a method for measuring in-situ a ground characteristic, the method comprising providing a hole in the ground, introducing an expansible sensor into the hole, expanding the expansible sensor into contact with ground walls of the hole and further expanding the expansible sensor into the ground walls of the hole, and measuring a first characteristic of the ground at the sensor as a function of a first pressure and a first volume of a selected extend of the further expansion of the expansible sensor, the improvement comprising:

supplying a liquid into the ground at the expansible sensor until a saturation point of the ground at the expansible sensor is reached;

maintaining the first volume constant while supplying the liquid by increasing the first pressure until a second pressure is reached at the saturation point of the ground, whereby the first volume will increase and the second pressure will decrease; and measuring a second characteristic of the ground at the sensor as a function of the difference of the first and second pressures, whereby the second characteristic is a ground heave characteristic.

2. The method according to claim 1, wherein the measuring of the first characteristic and the supplying of the liquid are effected successively.

3. The method according to claim 1, wherein the measuring of the first characteristic and the supplying of the liquid are effected simultaneously.

4. The method according to claim 1, wherein the liquid is water.

5. The method according to claim 2, wherein the liquid is water.

6. The method according to claim 3, wherein the liquid is water.

7. In a method for measuring in-situ a ground characteristic, the method comprising providing a hole in the ground, introducing an expansible sensor into the hole, expanding the expansible sensor into contact with ground walls of the hole and further expanding the expansible sensor into the ground walls of the hole, and measuring a first characteristic of the ground at the sensor as a function of a first pressure and a first volume of a selected extend of the further expansion of the expansible sensor, the improvement comprising:

supplying a liquid into the ground at the expansible sensor until a saturation point of the ground at the expansible sensor is reached;

maintaining the first pressure constant while supplying the liquid by decreasing the first volume until a second volume is reached at the saturation point of the ground, whereby the first pressure will decrease and the second volume will increase; and measuring a second characteristic of the ground at the sensor as a function of the difference of the first and second volumes, whereby the second characteristic is a ground heave characteristic.

8. The method according to claim 7, wherein the measuring of the first characteristic and the supplying of the liquid are effected successively.

9. The method according to claim 7, wherein the measuring of the first characteristic and the supplying of the liquid are effected simultaneously.

10. The method according to claim 7, wherein the liquid is water.

11. The method according to claim 8, wherein the liquid is water.

12. The method according to claim 9, wherein the liquid is water.

13. In a method for measuring in-situ a ground characteristic of ground walls of a hole, the device comprising an expansible sensor for introduction into the hole, expansion means for expanding the expansible sensor into contact with the ground walls of the hole and further expanding the expansible sensor into the ground walls of the hole, pressure and volume determining means for determining a first pressure and a first volume of a selected extent of the further expansion of the expansible sensor, and measuring means for measuring a first characteristic of the ground at the expansible sensor as a function of the first pressure and volume, the improvement further comprising:

supply means for supplying a liquid into the ground at the expansible sensor until a saturation point of the ground at the expansible sensor is reached; and wherein the determining means determines one of a second pressure and a second volume when the saturation point of the ground at the expansible sensor is reached; and the measuring means determines a second characteristic of the ground at the expansible sensor as a function of the difference of the one of the second pressure and volume from the corresponding one of the first thereof, whereby the second characteristic is a ground heave characteristic.

14. The device according to claim 13, wherein the expansible sensor has a first portion and a second portion respectively for determining the first and second pressure and volume.

15. The device according to claim 14, wherein the first and second portions of the expansible sensor are successive superposed axially of the hole.

16. The device according to claim 14, wherein each of the first and second portions of the expansible sensor comprise diametrically opposed sectors and the diametric oppositions of the first and second portions are 90° to each other.

* * * * *